US009885362B2

(12) United States Patent
He et al.

(10) Patent No.: US 9,885,362 B2
(45) Date of Patent: Feb. 6, 2018

(54) OSCILLATING FAN

(71) Applicants: Xiangming He, Jiangmen (CN); Guanglian Lin, Jiangmen (CN)

(72) Inventors: Xiangming He, Jiangmen (CN); Guanglian Lin, Jiangmen (CN)

( * ) Notice: Subject to any disclaimer, the term of this patent is extended or adjusted under 35 U.S.C. 154(b) by 341 days.

(21) Appl. No.: 14/637,436

(22) Filed: Mar. 4, 2015

(65) Prior Publication Data

US 2016/0208807 A1 Jul. 21, 2016

(30) Foreign Application Priority Data

Jan. 16, 2015 (CN) ..... 2015 2 0031623 U

(51) Int. Cl.
*F04D 25/10* (2006.01)

(52) U.S. Cl.
CPC ..... *F04D 25/105* (2013.01)

(58) Field of Classification Search
CPC ..... F04D 25/105; F04D 25/28; F04D 29/53; F04D 29/325; F04D 29/703; F04D 25/10; F16H 25/18; F16H 19/005; F16H 19/02; F16H 19/0622; F16H 19/08; F16H 37/122; F16H 37/16; F16H 1/006; F16H 13/06; F16H 1/321; F16H 23/02; F16H 25/08; F16H 25/16
USPC ..... 415/216
See application file for complete search history.

(56) References Cited

U.S. PATENT DOCUMENTS 1,456,433 A * 5/1923 Glasser ..... F04D 25/10 475/11
2,633,293 A * 3/1953 Jones ..... F04D 29/646 417/234
4,861,230 A * 8/1989 Breining ..... F04D 29/703 416/247 R
5,368,445 A * 11/1994 Litvin ..... F04D 29/601 248/159
7,771,167 B2 * 8/2010 Fu ..... F24F 7/007 416/100
2008/0304969 A1 * 12/2008 Fu ..... F04D 25/105 416/148
2011/0002784 A1 * 1/2011 Yu ..... F04D 25/105 416/100
2012/0156064 A1 * 6/2012 Birdsell ..... F04D 25/105 417/374
2012/0163989 A1 6/2012 Sun

FOREIGN PATENT DOCUMENTS

CN 101936300 A 1/2011
CN 103728888 A 4/2014

* cited by examiner

*Primary Examiner* — Aaron R Eastman
(74) *Attorney, Agent, or Firm* — Schmeiser, Olsen & Watts, LLP

(57) ABSTRACT

An oscillating fan, by adding an oscillating motor, to drive the drive gear to move along the periphery of the fixed gear, the oscillating motor of the fan is achieved is disclosed. The fan motor is only used for driving the blades to blow air in a rotating mode, so that the load of the fan motor is reduced, and the oscillating motor stability of the blades driven by the drive gear is ensured. Meanwhile, the installation space of the oscillating and rotating pivot part is reduced, so that the whole oscillating fan is small in size, convenient to transport.

7 Claims, 6 Drawing Sheets

OSCILLATING FAN

CROSS REFERENCE TO RELATED APPLICATION

This application claims priority to Chinese Application No. 201520031623.5 having a filing date of Jan. 16, 2015, the entire contents of which are hereby incorporated by reference.

TECHNICAL FIELD

The present invention relates to the field of electrical equipment, in particular to an oscillating fan.

BACKGROUND

At present, oscillating fans are widely applied to people's lives. Please refer to FIG. 1, the main structure of an oscillating and air blowing mechanism for an existing oscillating fan comprises a drive motor X1, blades X2, a reduction gear X3, planetary gears X4, and an oscillating supporting part X5. The blades X2 are arranged at the end portion of one end of a motor shaft of the drive motor X1 in a sleeving mode. The reduction gear X3 is fixedly arranged at the end portion of the other end of the motor shaft of the drive motor X1 in a sleeving mode and coaxially connected with one planetary pinion X41 of the planetary gears X4 through a drive shaft coaxial with the axis of the motor shaft of the drive motor X1. The oscillating supporting part X5 comprises a sphere X1 for supporting the drive motor X1 and a ball socket X52 for supporting the sphere X51 arranged in the ball socket X52, and the top end of the sphere X51 is fixedly connected with the bottom face of the drive motor X1 through a supporting column a perpendicular to the motor shaft of the drive motor X1 so as to support the drive motor X1, balance twisting force in the drive motor X1 produced by the planetary gears X4 and enhance the oscillating stability of the blades X2. However, the oscillating and air blowing mechanism of the existing oscillating fan has the following shortcomings:

(1) The oscillating supporting part X5 is perpendicular to the motor shaft of the drive motor X1, and the installation space required by the oscillating supporting part must be considered in addition when the oscillating and air blowing mechanism is needed to be installed in a fan casing, so that the whole oscillating and air blowing mechanism is large in required installation space and inconvenient to install. Meanwhile, the whole oscillating fan is large in size and inconvenient to transport.

(2) The oscillating supporting part X5 is perpendicular to the motor shaft of the drive motor X1, so that the motion amplitude of the drive motor X1 in the direction of the supporting column of the oscillating supporting part X5 is limited, the oscillating amplitude of the blades is limited, and the oscillating and air blowing range of the blades is reduced.

(3) Due to the fact that the air blowing and oscillating motion of the fan is driven by the drive motor X1, the load of the drive motor X1 is large. Meanwhile, the driving force of the drive motor X1 is directly transmitted to the planetary gears X4 through a reduction gear X3, and the stability of the driving force transmitted to the planetary gears X4 by the drive motor and the rotating speed cannot be ensured. When the rotating speed of the drive motor X1 is suddenly increased, the rotating speed of the planetary gears X4 is increased accordingly, so that the oscillation of the fan is unstable, and it is unfavorable for the oscillating work of the fan.

SUMMARY

The embodiments aim at overcoming the shortcomings in the prior art and provides an oscillating fan that is small in size, convenient to transport and install, large in oscillating range, simple in structure, and capable of reducing the load of a fan motor. In addition, an oscillating mechanism is stable in work.

The embodiments employ the following technical solution: An oscillating fan, comprising a fan support, an outer fan cover, an air blowing mechanism and an oscillating mechanism, wherein the outer fan cover is arranged on the fan support, and the air blowing mechanism and the oscillating mechanism are arranged in the outer fan cover. The outer fan cover comprises a front cover body and a rear cover body that are connected with each other. The air blowing mechanism comprises a fan motor and blades, and the periphery of a motor shaft of the fan motor is fixedly sleeved with the blades. The oscillating mechanism comprises an oscillating motor, a drive gear, a fixed gear and an oscillating and rotating pivot part. The oscillating motor is fixedly arranged on the other side opposite to one side provided with the motor shaft, in the fan motor. The driving gear is connected with the oscillating motor and connected with the fixed gear in a meshed mode, and the fixed gear is fastened on the inner side face of the rear cover body. The oscillating and rotating pivot part comprises a fixed ball socket and a rotating sphere, the fixed ball socket is fixedly formed in the front cover body, and the rotating sphere is arranged in the fixed ball socket, fixedly connected with the end portion of the motor shaft of the fan motor and located in front of the blades.

By adding an oscillating motor, to drive the drive gear to move along the periphery of the fixed gear, the oscillating motion of the fan is achieved. The fan motor is only used for driving the blades to blow air in a rotating mode, so that the load of the fan motor is reduced, and the oscillating motion stability of the blades driven by the drive gear is ensured. The fixed ball socket is fixedly formed in the front cover body, the rotating sphere is fixedly arranged at the end of the motor shaft of the fan motor, and the rotating sphere serves as a rotating pivot for the circumferential motion of the air blowing mechanism when the drive gear conducts 360-degree circumferential motion along the periphery of the fixed gear, so that the blades can conduct 360-degree circumferential motion while blowing air. Therefore, the fixed ball socket and the rotating sphere are arranged on the front cover body and the motor shaft of the fan motor respectively, it is favorable for ensuring the stability of the fan during the oscillating motion and enlarging the oscillating range of the fan. Meanwhile, the installation space for the oscillating and rotating pivot part is reduced, so that the whole oscillating fan is small in size, convenient to transport and install, large in oscillating range, simple in structure, and capable of reducing the load of the fan motor. In addition, the oscillating mechanism is stable during work.

The drive gear is connected with the oscillating motor through a change gear set that comprises a driving gear and a driven gear, the periphery of the motor shaft of the oscillating fan is fixedly sleeved with the driving gear, the driven gear is in meshed connection with the driving gear and in coaxial connection with the drive gear through a rotating shaft. The change gear set is favorable for reducing the rotating speed of the oscillating motor and then transmitting the rotating speed to the driving gear, so that the operation stability of the driving gear is ensured.

The oscillating mechanism further comprises an annular limit edge for limiting the motion track of the driving gear, the annular limit edge is arranged on the inner side face of the rear cover body and arranged around the driving gear and the fixed gear, and an inner ring of the annular limit edge is in butt joint with the periphery of the drive gear. The annular limit edge is favorable for ensuring the stability of the motion track of the drive gear and preventing the drive gear and the fixed gear from deflecting, and working stability is further ensured.

The motor shaft axis of the fan motor is collinear with the axis of the drive gear. The collineation of the motor axis of the oscillating motor and the motor axis of the fan motor is favorable for transmitting the oscillating driving force generated by the oscillating motor to the motor shaft of the fan faster and more stably so as to ensure that the blades are easy to drive, stable and balanced during oscillation.

The fixed ball socket is fixedly formed in the middle of the front cover body, the fixed gear is in shaft connection with the middle of the inner side face of the rear cover body, the axis of the fixed gear is collinear with the horizontal central axis of the fixed ball socket, and therefore, it is favorable for ensuring the oscillating balance and stability of the blades further.

The front cover body and the rear cover body are in detachable connection through a plurality of screws, so that the front cover body is conveniently separated from the rear cover body, and the cleaning of the blades and the maintenance of fault components are facilitated.

The fan support with a W-shaped vertical projection face is formed by a bending metal pipe fitting and comprises a horizontal supporting frame and two inclined installation frames fixedly arranged at the end portions of the two ends of the horizontal supporting frame in an inclined mode respectively. Therefore, it is favorable for reducing the occupied space of the fan support and enhancing the durability of the fan support, and the fan support is conveniently applied to small space.

The two opposite sides of the outer fan cover are connected with the top ends of the two inclined installation frames through locking bolts, wherein the head portion of each locking bolt is fixedly sleeved with a knob. Therefore, the fan support is conveniently separated from the other structures of the oscillating fan, the fan support can be replaced according to the practical requirements of the use space, and the air blowing mechanism and the oscillating mechanism that are arranged in the outer fan cover are moved to another fan support with a larger or smaller volume.

As another structure of the fan support, the fan support comprises a base, a lifting vertical column and an installation frame, wherein the lifting vertical column is vertically arranged on the top face of the base, and the installation frame is fixedly arranged at the top end of the lifting vertical column. The two opposite sides of the outer fan cover are installed in the installation frame through locking bolts, wherein the head of each locking bolt is fixedly sleeved with a knob.

For better comprehension and implementation, the oscillating fan is illustrated in details with the drawings.

BRIEF DESCRIPTION

The present invention will be further described with reference to the accompanying drawings and particular embodiments, wherein.

DETAILED DESCRIPTION

Figure 1:
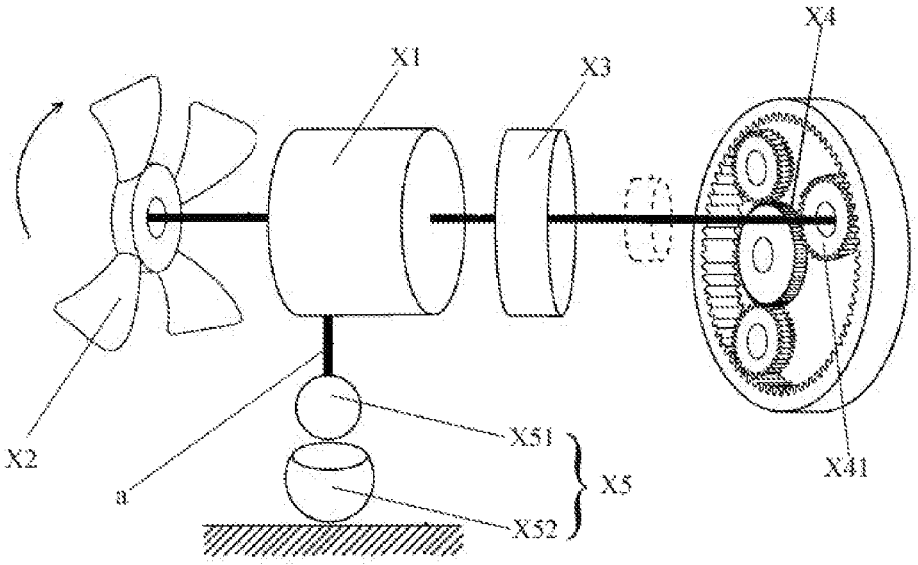
Fig. 1 PRIOR ART
FIG. 1 is a structure diagram of the oscillating fan in the related art.
Figure 2:
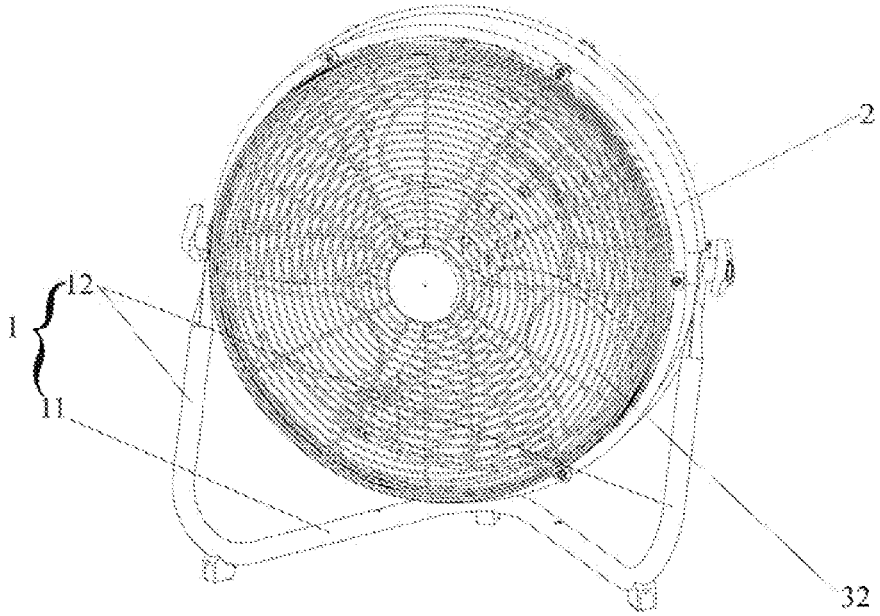
FIG. 2 is a structure diagram of the oscillating fan.
Figure 3:
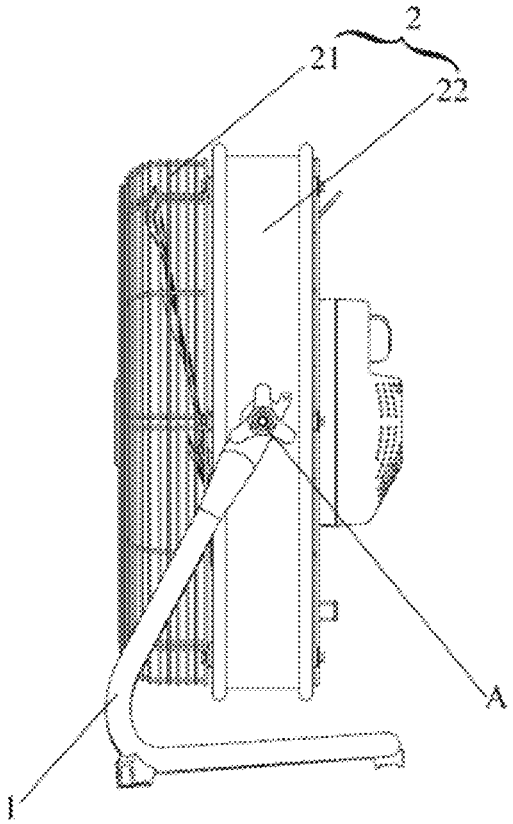
FIG. 3 is a side view structure diagram of the oscillating fan.
Figure 4:
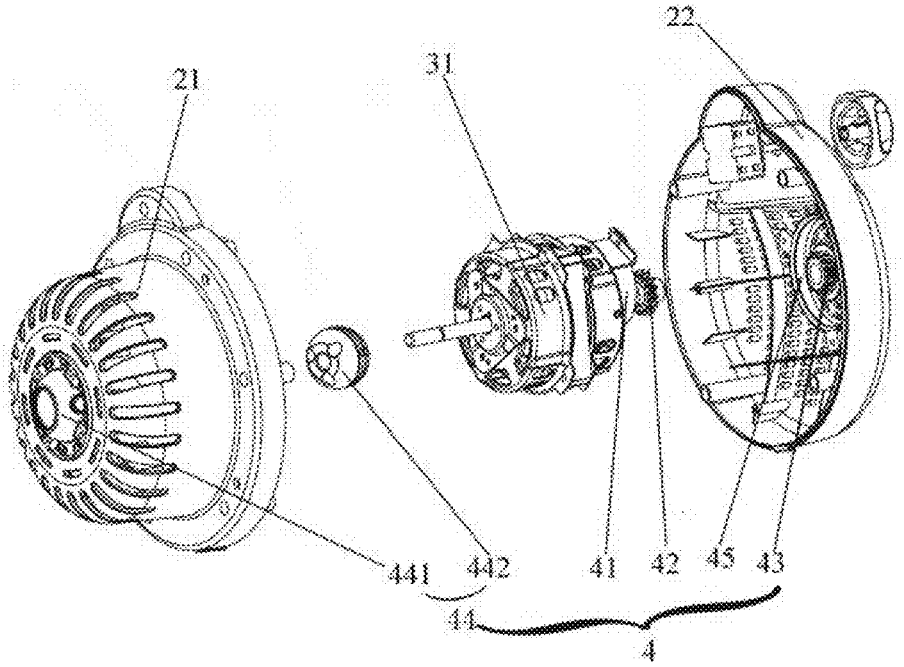
FIG. 4 is a local structural decomposition diagram of the oscillating fan.

Referring to FIG. 2, FIG. 3 and FIG. 4, an oscillating fan, comprising a fan support 1, an outer fan cover 2 and an air blowing mechanism and an oscillating mechanism 4. The outer fan cover 2 is arranged on the fan support 1, and the air blowing mechanism and the oscillating mechanism 4 are connected and arranged in the outer fan cover 2.

The fan support 1 with a W-shaped vertical projection face is formed by bending a metal pipe fitting and comprises a V-shaped horizontal supporting frame 11 and two inclined installation frames 12 fixedly arranged at the end portions of the two ends of the horizontal supporting frame 11 in an inclined mode respectively.

The outer fan cover 2 comprises a front cover body 21 and a rear cover body 22 that are connected with each other. In order to clean and maintain the outer fan cover conveniently, preferably, the front cover body 21 and the rear cover body 22 are in detachable connection through a plurality of screws. The two opposite sides of the outer fan cover 2 formed by connecting the front cover body 21 and the rear cover body 22 are connected with the top ends of the two inclined installation frames 12 through locking bolts A, wherein the head portion of each locking bolt is fixedly sleeved with a knob.

The air blowing mechanism comprises a fan motor 31, blades 32 and an air blowing switch controller. The periphery of the motor shaft of the fan motor 31 is fixedly sleeved with the fans 32. The air blowing switch controller is arranged outside the outer fan cover 2 and electrically connected with the fan motor 31 to control the rotating speed and the working state of the fan motor 31. Due to the fact that the air blowing switch controller of the oscillating fan has the same structure as an existing air blowing switch controller, it is not covered herein.

Referring to FIG. 4, the oscillating mechanism 4 comprises an oscillating motor 41, a drive gear 42, a fixed gear 43, an oscillating and rotating pivot part 44 and an oscillating switch controller. The oscillating motor 41 is fixedly arranged on the other side opposite to one side provided with the motor shaft, in the fan motor 31 through a gear box casing. The periphery of the motor shaft of the oscillating fan 41 is fixedly sleeved with the drive gear 42 in meshed connection with the fixed gear 43. The fixed gear 43 is fastened to the inner side face of the rear cover body 22. An oscillating and rotating pivot part 44 comprises a fixed ball socket 441 and a rotating sphere 442, the fixed ball socket 441 is fixedly formed in the front cover body 21, and the rotating sphere 442 is arranged in the fixed ball socket 441, fixedly connected with the end portion of the motor shaft of the fan motor 31 and located in front of the blades 32. An oscillating switch controller is arranged outside the rear cover body 22 of the outer fan cover 2 and electrically connected with the oscillating fan 41 to control the working state of the oscillating fan 41. Due to the fact that the structure of the oscillating switch controller of the oscillating fan has the same structure as an existing oscillating switch controller, it is not covered herein.

In order to avoid deflection of the drive gear 42 and the fixed gear 43 and further ensure the motion track and working stability of the drive gear 42, as a better technical scheme, the oscillating mechanism 4 further comprises an annular limit edge 45 for limiting the motion track of the drive gear 42, the annular limit edge 45 is arranged on the inner side face of the rear cover body 22 and arranged around the drive gear 42 and the fixed gear 43, and an inner ring of the annular limit edge is in butt joint with the periphery of the drive gear 42.

Furthermore, in order to ensure that the blades are easy to drive, stable, and balanced during oscillation work, as a better technical scheme, the motor shaft axis of the fan motor 31 is collinear with the axis of the drive gear 42. The fixed ball socket 441 is fixedly formed in the middle of the front cover body 21. The fixed gear 43 is fastened in the middle of the inner side face of the rear cover body 22, and the axis of the fixed gear is collinear with the horizontal central axis of the fixed ball socket 441.

The working principle of the oscillating fan is elaborated as follows:

When the oscillating fan only needs to blow air, the air blowing mechanism works, the oscillating mechanism 4 does not work, in other words, the fan motor 31 is controlled by the air blowing switch controller to rotate so as to drive the fan blades 32 to rotate and produce air. At the moment, the oscillating motor 41 is not started under control of the oscillating switch controller. If the rotating speed of the fan motor 31 needs to be switched, switches are selected through the air blowing switch controller, and the rotating speed of the fan motor 31 is changed.

When the air blowing work and the oscillating work are conducted at the same time through the oscillating fan, the air blowing mechanism and the oscillating mechanism 4 work at the same time. The fan motor 31 is controlled by the air blowing switch controller to rotate, and the oscillating motor 41 is controlled by the oscillating switch controller to rotate at the same time. The fan motor 31 drives the blades 32 to rotate and generate air, the oscillating motor 41 drives the drive gear 42 to conduct meshed motion along the periphery of the fixed gear 43, and 360-degree rotation is achieved and transmitted to the fan motor 31 to drive the fan motor 31 to conduct the circumferential motion with the rotating sphere 442 serving as a rotating pivot, so that the blades 32 conduct the circumferential motion, and the air blowing range of the blades 32 is enlarged. At the moment, the rotating sphere 442 conducts the 360-degree motion in the fixed ball socket 441.

Figure 5:
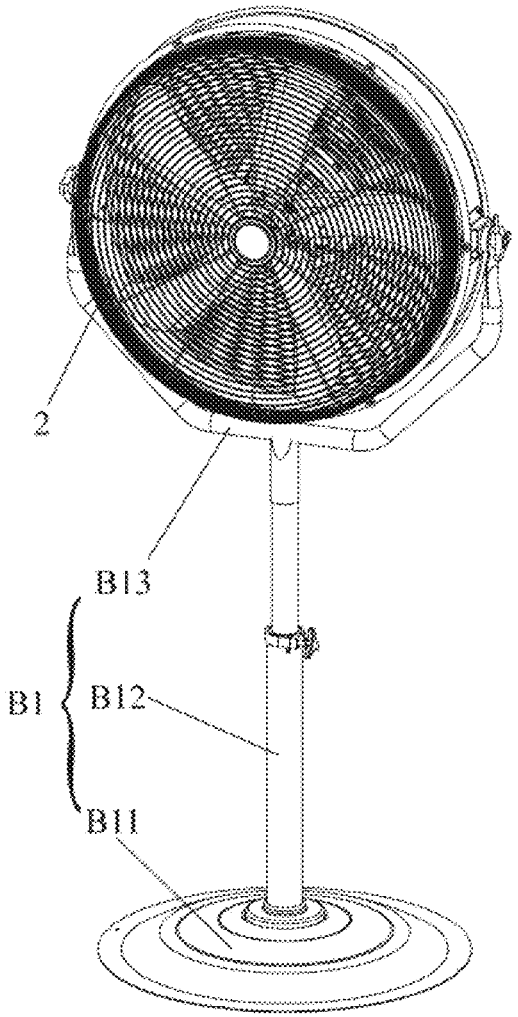
FIG. 5 is a structure diagram of the oscillating fan in a varied first embodiment of the utility model.

In addition, the utility model further provides other varied embodiments, for example:

(1) Referring to FIG. 5, the structure of a varied first fan support, namely the fan support B1 comprises a base B11, a lifting vertical column B12 and an installation frame B13, wherein the lifting vertical column is vertically arranged on the top face of the base, and the installation frame is fixedly arranged at the top end of the lifting vertical column. The two opposite sides of the outer fan cover 2 are installed in the installation frame B13 through locking bolts, wherein the head of each locking bolt is fixedly sleeved with a knob.

Figure 6:
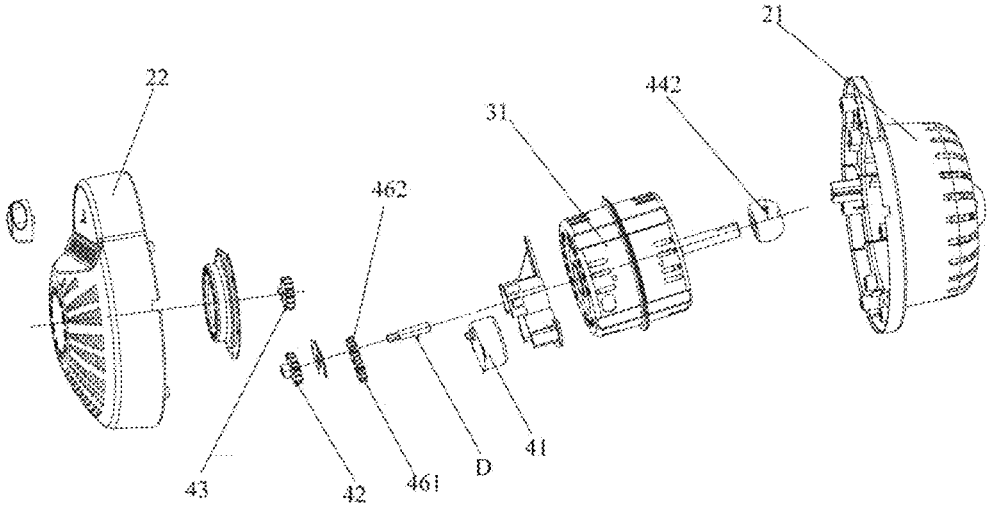
FIG. 6 is a local structural decomposition diagram of the oscillating fan in a varied second embodiment of the utility model.
Figure 7:
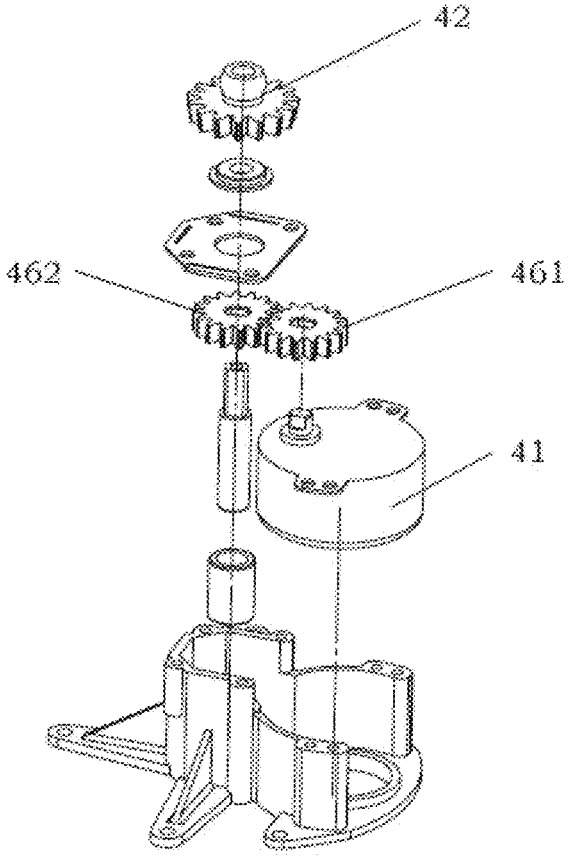
FIG. 7 is a local structural decomposition diagram of the oscillating mechanism in the varied second embodiment of the utility model.
Figure 8:
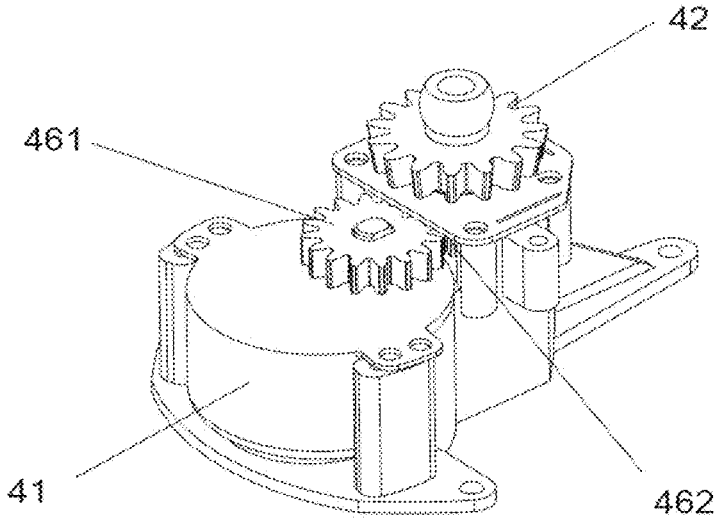
FIG. 8 is a structure diagram of the combined structures illustrated by FIG. 7.

(2) Referring to FIG. 6-FIG. 8, a change gear set is additionally arranged, the connection relation between the drive gear 42 and the oscillating motor 41 is changed, in other words, the drive gear 42 is connected with the oscillating motor 41 through the change gear set. The change gear set comprises a driving gear 461 and a driven gear 462, the periphery of the motor shaft of the oscillating motor 41 is fixedly sleeved with the driving gear 461, the driven gear 462 is in meshed connection with the driving gear 461 and coaxially connected with the drive gear 42, and the driven gear 462 is coaxially connected with the drive gear 42 through a rotating shaft D.

Compared with the prior art, the oscillating fan is small in size, convenient to transport and install, large in oscillating range, simple in structure, and capable of reducing the load of a fan motor. In addition, the oscillating mechanism is stable in work.

The utility model is not limited to the embodiments, if various modifications and variations of the utility model do not depart from the spirit and scope of the utility model and belong to the claims and the equivalent technical scope of the utility model, it is intended that the modifications and variations are covered thereby.

What is claimed is:

1. An oscillating fan, comprising a fan support, an outer fan cover, an air blowing mechanism and an oscillating mechanism, wherein the outer fan cover is arranged on the fan support, and the air blowing mechanism and the oscillating mechanism are arranged in the outer fan cover; wherein the outer fan cover comprises a front cover body and a rear cover body that are connected with each other; wherein the air blowing mechanism comprises a fan motor and blades, and the periphery of a motor shaft of the fan motor is fixedly sleeved with the blades; wherein the oscillating mechanism comprises an oscillating motor, a drive gear, a fixed gear and an oscillating and rotating pivot part and the oscillating motor is fixedly arranged on the other side opposite to one side provided with the motor shaft, in the fan motor; wherein the driving gear is connected with the oscillating motor and connected with the outer circumference of the fixed gear in a meshed mode, and the fixed gear is fastened on the inner side face of the rear cover body; and wherein the oscillating and rotating pivot part comprises a fixed ball socket and a rotating sphere, the fixed ball socket is fixedly formed in the front cover body, and the rotating sphere is arranged in the fixed ball socket, fixedly connected with the end portion of the motor shaft of the fan motor and located in front of the blades; wherein the fixed ball socket is fixedly formed in the middle of the front cover body, the fixed gear is in shaft connection with the middle of the inner side face of the rear cover body, the axis of the fixed gear is collinear with the horizontal central axis of the fixed ball socket; wherein the oscillating mechanism further comprises an annular limit edge for limiting the motion track of the driving gear, the annular limit edge is arranged on the inner side face of the rear cover body and arranged around the driving gear and the fixed gear, and an inner ring of the annular limit edge is in butt joint with the periphery of the drive gear.

2. The oscillating fan of claim 1, wherein the drive gear is connected with the oscillating motor through a change gear set that comprises a driving gear and a driven gear, the periphery of the motor shaft of the oscillating fan is fixedly sleeved with the driving gear, the driven gear is in meshed connection with the driving gear and in coaxial connection with the drive gear through a rotating shaft.

3. The oscillating fan of claim 1, wherein the motor shaft axis of the fan motor is collinear with the axis of the drive gear.

4. The oscillating fan of claim 1, wherein the front cover body and the rear cover body are in detachable connection through a plurality of screws.

5. The oscillating fan of claim 1, wherein the fan support has a W-shaped vertical projection face and is formed by a bending metal pipe fitting and comprises a horizontal supporting frame and two inclined installation frames fixedly arranged at end portions of two ends of the horizontal supporting frame in an inclined mode respectively.

6. The oscillating fan of claim 5, wherein two opposite sides of the outer fan cover are connected with top ends of the two inclined installation frames through locking bolts, wherein a head portion of each locking bolt is fixedly sleeved with a knob.

7. The oscillating fan of claim 1, wherein the fan support comprises a base, a lifting vertical column and an installation frame, wherein the lifting vertical column is vertically arranged on a top face of the base, and the installation frame is fixedly arranged at a top end of the lifting vertical column; and two opposite sides of the outer fan cover are installed in the installation frame through locking bolts, wherein a head of each locking bolt is fixedly sleeved with a knob.

* * * * *